US008698680B2

(12) United States Patent
Gutschenritter et al.

(10) Patent No.: US 8,698,680 B2
(45) Date of Patent: Apr. 15, 2014

(54) WATCH WITH IMPROVED GROUND PLANE

(75) Inventors: Kathryn M. Gutschenritter, Overland Park, KS (US); Jeremiah H. Estes, Olathe, KS (US); Thomas J. Vehlewald, Olathe, KS (US)

(73) Assignee: Garmin Switzerland GmbH (CH)

( * ) Notice: Subject to any disclaimer, the term of this patent is extended or adjusted under 35 U.S.C. 154(b) by 163 days.

(21) Appl. No.: 13/351,991

(22) Filed: Jan. 17, 2012

(65) Prior Publication Data

US 2013/0181873 A1 Jul. 18, 2013

(51) Int. Cl.
*H01Q 7/00* (2006.01)

(52) U.S. Cl.
USPC ..... 343/718; 343/846; 343/848

(58) Field of Classification Search
USPC ..... 343/718, 846, 848
See application file for complete search history.

(56) References Cited

U.S. PATENT DOCUMENTS

| | | | | |
|---|---|---|---|---|
| 3,405,681 | A * | 10/1968 | Gugler | 118/25 |
| 5,014,040 | A * | 5/1991 | Weaver et al. | 340/568.1 |
| 5,699,319 | A * | 12/1997 | Skrivervik | 368/10 |
| 6,128,515 | A | 10/2000 | Kabler et al. | 455/566 |
| 7,417,596 | B2 | 8/2008 | Zellweger et al. | 343/718 |
| 7,538,723 | B2 | 5/2009 | Davis et al. | 342/357.06 |
| 7,828,697 | B1 | 11/2010 | Oberrieder et al. | 482/8 |
| 2002/0022459 | A1 * | 2/2002 | Kobayashi | 455/90 |
| 2005/0048804 | A1 * | 3/2005 | Henriet et al. | 439/37 |
| 2006/0227058 | A1 * | 10/2006 | Zellweger et al. | 343/718 |
| 2008/0049562 | A1 * | 2/2008 | Andren et al. | 368/295 |

* cited by examiner

*Primary Examiner* — Dameon Levi
*Assistant Examiner* — Collin Dawkins
(74) *Attorney, Agent, or Firm* — Samuel M. Korte; Mohammad M. Ali

(57) ABSTRACT

Watches comprising an antenna are described herein. In an implementation, a watch includes a housing enclosing an antenna, a printed circuit board, and a conductive cage. The antenna may be provided with a ground plane including a first portion and second portion. The first portion of the ground plane may be formed by the printed circuit board electrically coupled with the antenna and the second portion of the ground plane may be formed by the conductive cage supporting the printed circuit board and electrically coupled thereto.

22 Claims, 8 Drawing Sheets

WATCH WITH IMPROVED GROUND PLANE

BACKGROUND

The Global Positioning System (GPS) is a satellite-based system that includes a number of satellites orbiting the Earth. These satellites transmit signal information to earth.

A device that includes a GPS receiver may utilize the signal information to determine a location of the device. For example, the GPS receiver may compare the time that signal information was transmitted by a satellite with the time that it was received to calculate a time difference. The time difference can indicate a distance from the satellite to the GPS receiver. This process may be performed with a number of satellites to determine a number of distance measurements, e.g., from each of the respective satellites, in order to determine the location of the device.

DETAILED DESCRIPTION

Figure 1:
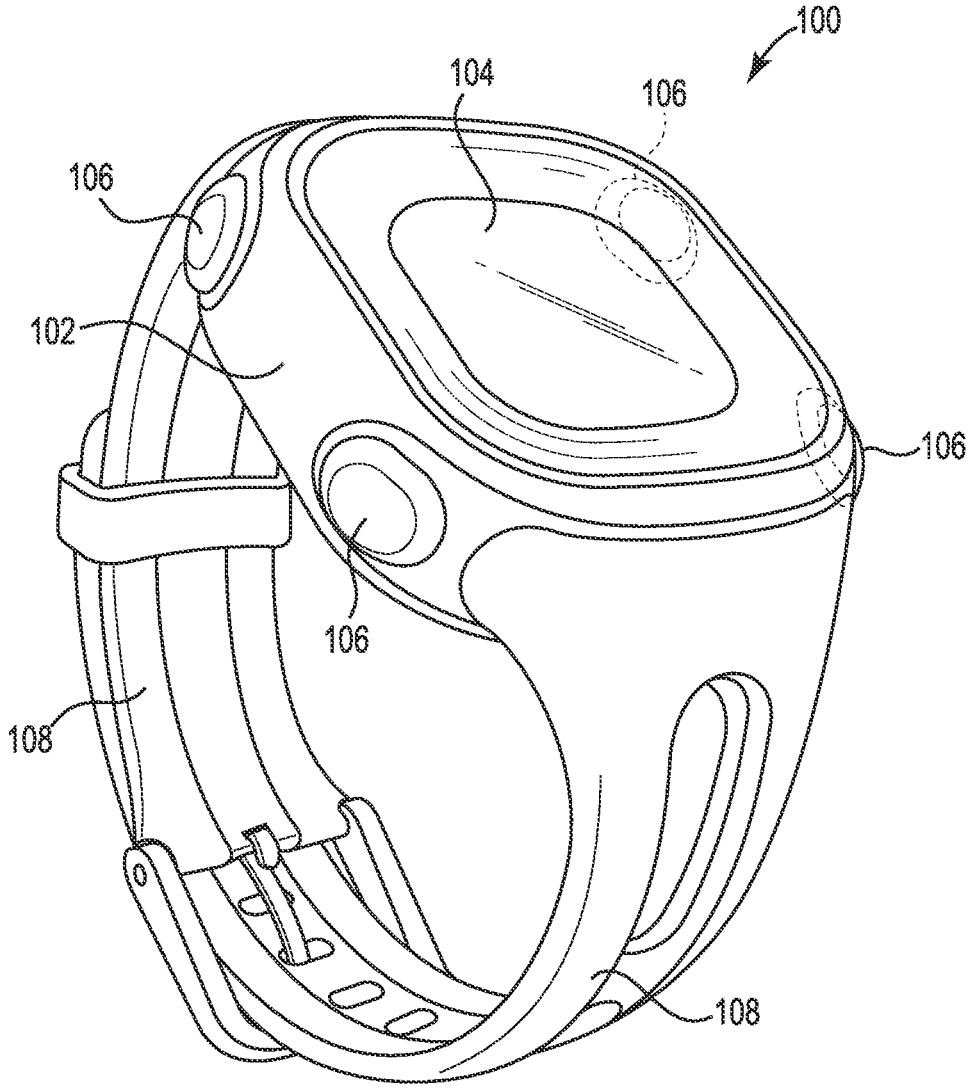
FIG. 1 is a perspective view of a watch in accordance with one or more embodiments of the present disclosure.

In the detailed description of the present disclosure, reference is made to the accompanying drawings that form a part hereof, and in which is shown by way of illustration how one or more embodiments of the disclosure may be practiced. These embodiments are described in sufficient detail to enable those of ordinary skill in the art to practice the embodiments of this disclosure, and it is to be understood that other embodiments may be utilized and that process, electrical, and/or structural changes may be made without departing from the scope of the present disclosure.

The figures herein follow a numbering convention in which the first digit or digits correspond to the drawing figure number and the remaining digits identify an element or component in the drawing. Similar elements or components between different figures may be identified by the use of similar digits.

For some devices, e.g., watches, the size and performance of the device can be important considerations. For example, it may be advantageous to provide a reduced size device, while providing desirable performance in reception and/or transmission of a signal, such as a GPS signal. Reception and/or transmission of a signal can be affected by the design and implementation of a wireless device's antenna. As used herein, a GPS signal refers to any GPS signal or equivalent thereof, such as another global navigation satellite system (GNSS) signal.

Embodiments of the present disclosure include watches. The watches, as disclosed herein, can include an antenna operable to receive position determining signals and provided with a ground plane including a first portion and a second portion, a printed circuit board electrically coupled with the antenna to form the first portion of the ground plane, a processor coupled with the printed circuit board and operable to process the position determining signals received by the antenna, a conductive cage supporting the printed circuit board and electrically coupled thereto to form the second portion of the ground plane, and a housing substantially enclosing the antenna, the printed circuit board, and the conductive cage. Embodiments of the present disclosure can provide benefits such as increasing performance in reception and/or transmission of a signal, such as a GPS signal, without increasing the size of the watch housing by using a conductive cage supporting a circuit board that forms a second portion of an antenna ground plane.

FIG. 1 is a perspective view of a watch 100 in accordance with one or more embodiments of the present disclosure. The watch 100 includes a housing 102. The housing 102 is configured to house, e.g., substantially enclose, various components of the watch 100. The housing 102 may be formed from a lightweight and impact-resistant material such as plastic, nylon, or combinations thereof, for example. The housing 102 may be formed from a non-conductive material, such a non-metal material, for example. The housing 102 may include one or more gaskets, e.g., a seal, to make it substantially waterproof or water resistant. The housing 102 may include a location for a battery and/or another power source for powering one or more components of the watch 100. The housing 102 may be a singular piece or may include a plurality of sections. In embodiments, the housing 102 may be formed from a conductive material, such as metal, or a semi-conductive material.

The watch 100 includes a display 104. The display 104 may include a liquid crystal display (LCD), a thin film transistor (TFT), a light-emitting diode (LED), a light-emitting polymer (LEP), and/or a polymer light-emitting diode (PLED). However, embodiments are not so limited. The display 104 may be capable of displaying text and/or graphical information. The display 104 may be backlit such that it may be viewed in the dark or other low-light environments. One example of the display 104 is a 100 pixel by 64 pixel film compensated super-twisted nematic display (FSTN) including a bright white light-emitting diode (LED) backlight. However, embodiments are not so limited. The display 104 may include a transparent lens that covers and/or protects components of the watch 100.

In accordance with one or more embodiments of the present disclosure, the watch 100 includes a control button 106. As illustrated in FIG. 1, the control button 106 is associated with, e.g., adjacent, the housing 102. While FIG. 1 illustrates four control buttons 106 associated with the housing 102, embodiments are not so limited. For example, the watch 100 may include fewer than four control buttons 106, such as one, two, or three control buttons. Additionally, the watch 100 may include more than four control buttons 106, such as five, six, or seven, for example. The control button 106 is configured to control a function of the watch 100. Functions of the watch 100 may be associated with a location determining component and/or a performance monitoring component. Functions of the watch 100 may include, but are not limited to, displaying a current geographic location of the watch 100, mapping a location on the display 104, locating a desired location and displaying the desired location on the display 104, monitoring a user's heart rate, monitoring a user's speed, monitoring a distance traveled, calculating calories burned, and the like. In embodiments, user input may be provided from movement of the housing 102. For example, an accelerometer may be used to identify tap inputs on the housing 102 or upward and/or sideways movements of the housing 102. In embodiments, user input may be provided from touch inputs identified using various touch sensing technologies, such as resistive touch or capacitive touch interfaces.

In accordance with one or more embodiments of the present disclosure, the watch 100 includes a strap 108. As illustrated in FIG. 1, the strap 108 is associated with, e.g., coupled to, the housing 102. For example, the strap 108 may be removably secured to the housing 102 via attachment of securing elements to corresponding connecting elements. Examples of securing elements and/or connecting elements include, but are not limited to hooks, latches, clamps, snaps, and the like. The strap 108 may be made of a lightweight and resilient thermoplastic elastomer and/or a fabric, for example, such that the strap 108 may encircle a portion of a user without discomfort while securing the housing 102 to the user. The strap 108 may be configured to attach to various portions of a user, such as a user's leg, waist, wrist, forearm, and/or upper arm.

Figure 2A:
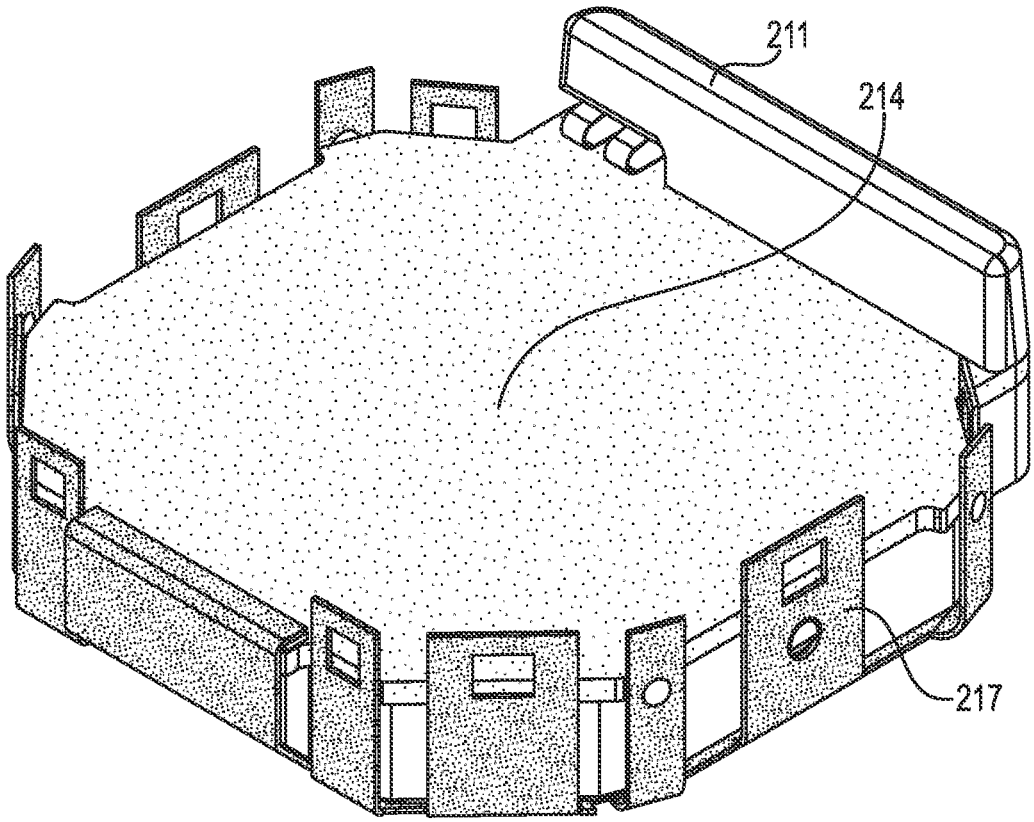
FIG. 2A is a perspective view of a portion of a watch in accordance with one or more embodiments of the present disclosure.

FIG. 2A is a perspective view of a portion of a watch in accordance with one or more embodiments of the present disclosure. The watches disclosed herein can include a location determining component 210 positioned within the housing (not shown in FIG. 2A). For example, the location determining component 210 may include an antenna 211 having a ground plane including a first portion 214 and a second portion 217. The first portion 214 of the ground plane may be formed by coupling a printed circuit board with the antenna 211. The second portion 217 of the ground plane may be formed by coupling a conductive cage to the first portion 214, which may be formed by a printed circuit board. The antenna 211, first portion 214 of the ground plane, and second portion 217 of the ground plane may be coupled using solder, connection elements, or combinations thereof.

The location determining component 210 may be a GPS receiver that is configured to provide geographic location information of the watch. The location determining component 210 may be, for example, a GPS receiver such as those provided in various products by GARMIN®.

Generally speaking, GPS is a satellite-based radio navigation system capable of determining continuous position, velocity, time, and direction information. Multiple users may simultaneously utilize GPS. GPS incorporates a plurality of GPS satellites that orbit the earth. Based on these orbits, GPS satellites can relay their location to a GPS receiver. For example, upon receiving a GPS signal, e.g., a radio signal, from a GPS satellite, the watch disclosed herein can determine a location of that satellite. The watch can continue scanning for GPS signals until it has acquired a number, e.g., at least three, of different GPS satellite signals. The watch may employ geometrical triangulation, e.g., where the watch utilizes the known GPS satellite positions to determine a position of the watch relative to the GPS satellites. Geographic location information and/or velocity information can be updated, e.g., in real time on a continuous basis, for the watch.

The location determining component 210 may include one or more processors, controllers, and/or other computing devices as well as a memory, e.g., for storing information accessed and/or generated by the processors or other computing devices. The processor may be electrically coupled with a printed circuit board and operable to process position determining signals received by the antenna 211. The location determining component 210, e.g., the antenna 211, is configured to receive position determining signals, such as GPS signals from GPS satellites, to determine a current geographic location of the watch. The location determining component 210 may also be configured to calculate a route to a desired location, provide instructions, e.g., directions, to navigate to the desired location, display maps and other information on the display, and to execute other functions, such as, but not limited to, those functions described herein. The memory may store cartographic data and routing used by or generated by the location determining component 210. The memory may be integral with the location determining component 210, stand-alone memory, or a combination of both. The memory may include, for example, a removable nonvolatile memory card, such as a TransFlash card.

The antenna 211, for example, may be configured to receive and/or transmit a signal, such as a GPS signal. Antenna 211 may be any antenna capable of receiving wireless signals from a remote source, including directional antennas and omnidirectional antennas. Antenna 211 may include any type of antennas in which the length of the ground plane affects the efficiency of the antenna. In accordance with one or more embodiments of the present disclosure, the antenna 211 is an omnidirectional antenna having a ground plane. An omnidirectional antenna may receive and/or transmit in both orthogonal polarizations, depending upon direction. In other words, omnidirectional antennas do not have a predominant direction of reception and/or transmission. Examples of omnidirectional antennas include, but are not limited to, inverted-F antennas (IFAs) and planar inverted-F antennas (PIFAs). In contrast to omnidirectional antennas, directional antennas have a primary lobe of reception and/or transmission over an approximate 70 by 70 degree sector in a direction away from the ground plane. Examples of directional antennas include, but are not limited to, microstrip antennas and patch antennas.

In accordance with one or more embodiments of the present disclosure the antenna 211 may be an embedded antenna. As used herein, an embedded antenna refers to an antenna that is positioned completely within a device housing. For example, antenna 211 may be positioned completely within housing 102. In some embodiments, antenna 211 may be an external antenna with all or a portion of the antenna 211 exposed from housing 102.

Figure 2B:
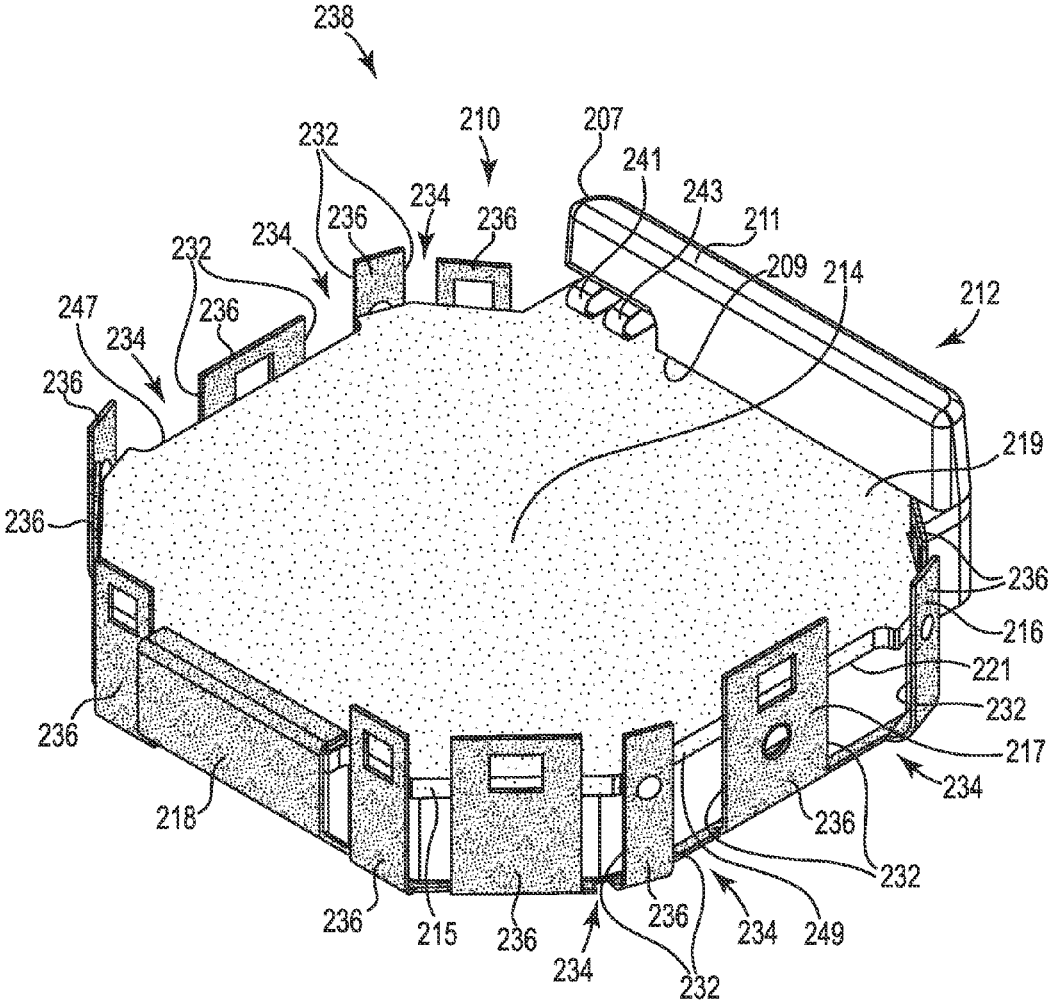
FIG. 2B is a perspective view of a portion of a watch in accordance with one or more embodiments of the present disclosure.

FIG. 2B is a perspective view of a portion of a watch in accordance with one or more embodiments of the present disclosure. FIG. 2B illustrates an internal assembly 238, which is positioned within the housing 102 of the watch. The internal assembly 238 may include, for instance, the location determining component 210, the PCB 215, and the conductive cage 216. The location determining component 210 may include an antenna 211 having a ground plane including a first portion 214 and a second portion 217. The first portion 214 of the ground plane may be formed by coupling a printed circuit board 215 with the antenna 211. The second portion 217 of the ground plane may be formed by coupling a conductive cage 216 to the first portion 214, which may be formed by a printed circuit board 215.

As discussed, the location determining component 210 includes the antenna 211. The antenna 211 may be associated with, e.g., formed on and/or within, an antenna support assembly 212. The antenna support assembly 212 may include a top portion 207 and a bottom portion 209. As an example, the antenna 211 may be positioned on the top portion 207 of the antenna support assembly 212 along a first plane.

As discussed, the ground plane includes the first portion 214 and the second portion 217. The first portion 214 of the ground plane may be formed by coupling the printed circuit board (PCB) 215 with the antenna 211. The PCB 215 may support a number of processors, microprocessors, controllers, microcontrollers, programmable intelligent computers (PIC), field-programmable gate arrays (FPGA), other processing components, other field logic devices, application specific integrated circuits (ASIC), and/or a memory that is configured to access and/or store information that is received or generated by the watch. The watch may implement one or more software programs to control text and/or graphical information on the display, as discussed herein. As an example, the PCB 215 may support the bottom portion 209 of the antenna support assembly 212 along a second plane, where the second plane is offset from a first plane of the antenna 211 positioned on the top portion 207 of the antenna support assembly 212. In some embodiments, the antenna support assembly 212 and antenna 211 may be positioned in the center of the top side 219 or a bottom surface of PCB 215 or to a side of the of PCB 215.

One example of the PCB 215 is a ten layer printed circuit board, where two of the layers are solid ground layers and the other eight layers include components and traces with ground copper filling located in spaces not used for components or traces. The PCB 215 may include vias to aid communication between various layers of the PCB 215, e.g., conductive traces throughout the PCB 215 to connect the separate ground layers and other layers. Components of the PCB 215 may be placed on either side, both sides, or within the layers of the PCB 215. For example, components of the watch may be placed on a top side 219 of the PCB 215 and/or a bottom side 221 of the PCB 215. As illustrated in FIG. 2B, the antenna support assembly 212 maybe placed on the top side 219 of the PCB 215. However, embodiments are not so limited. The antenna support assembly 212 may be secured to the top side 219 of the PCB 215 by one or more mating elements and electrical contacts. For example, an adhesive or heat processing may be used to mate or couple the antenna support assembly 212 to the PCB 215. A first electrical contact 241 and a second electrical contact 243 may be employed to electrically couple the antenna 211 with the PCB 215. In some implementations, electrical contact between conductive elements may be provided using solder, conductive elastomers, and the like. An example of the first electrical contact 241 and a second electrical contact 243 includes, but is not limited to, a conductive spring, a conductive tab, a conductive bridge, and combinations thereof.

The watches disclosed herein include a conductive cage 216 positioned within the housing. In various embodiments, the conductive cage 216 supports the PCB 215. In some embodiments, conductive cage 216 does not support the PCB 215 and is positioned independent of PCB 215 in housing 102. For example, conductive cage 216 may electrically couple with PCB 215 and fold under the PCB 215 without providing any support for the PCB 215. In embodiments, the conductive cage may be positioned substantially parallel to PCB 215 or as space is available in the inner area of housing 102. The conductive cage 216 includes a connection element 218 to electrically couple with the PCB 215 to form the second portion 217 of the ground plane. Examples of the connection element 218 include, but are not limited to, a conductive spring, a conductive tab, a conductive bridge, and combinations thereof. The connection element 218 includes a conductive material, such as a metal or a metal alloy, to electrically couple the conductive cage 216 with the PCB 215.

In accordance with one or more embodiments of the present disclosure, the conductive cage 216 is a conductive material, such as a metal or a metal alloy. In embodiments, the conductive cage 216 may be formed of a non-conductive or semi-conductive material and a conductive layering (e.g., metallic plating). As illustrated in FIG. 2B, the conductive cage 216 may be coupled to a portion of the PCB 215 that is opposite of the antenna support assembly 212.

In some embodiments, elements of the internal assembly 238 may be electrically coupled using solder, connection elements, or combinations thereof. For example, solder may be used to couple the PCB 215 with the location determining component 210 and/or the conductive cage 216. The solder may be applied to one or more ends of the first electrical contact 241, the second electrical contact 243, and the connection element 218 of the conductive cage 216 during the manufacture process. In some embodiments, solder may be used in place of or in combination with a conductive spring, a conductive tab, or a conductive bridge.

Figure 2C:
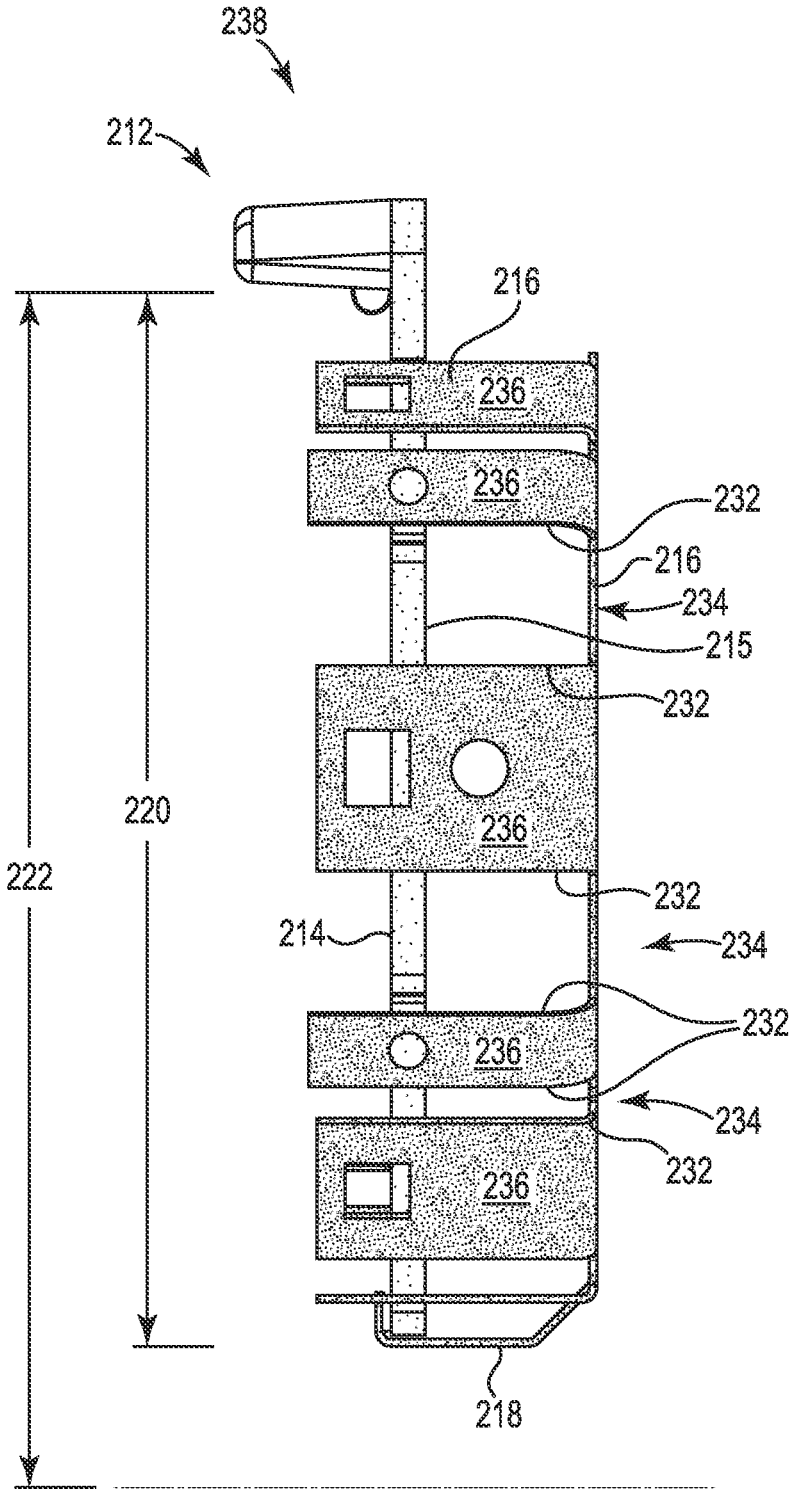
FIG. 2C is a side view of a portion of a watch in accordance with one or more embodiments of the present disclosure.

FIG. 2C is a side view of a portion of a watch in accordance with one or more embodiments of the present disclosure. FIG. 2C shows a length 220 length of the first portion 214 of the ground plane. The ground planes of conventional designs may be limited to a ground plane of PCB 215. Additionally, FIG. 2C illustrates a hypothetical effective ground plane length 222 achieved by coupling the conductive cage 216 with the PCB 215, e.g., a sum of the first portion 214 of the ground plane and the second portion 217 of the ground plane. As seen in FIGS. 2A through 2D, the second portion 217 of the ground plane helps to provide an effective ground plane length 222 that is greater than the length 220 of the first portion 214 of the ground plane absent the second portion 217 of the ground plane. This second portion 217 of the ground plane effectively increases a length of the ground plane, e.g. from length 220 to length 222, without increasing the dimensions of the PCB 215. Additionally, the second portion 217 of the ground plane improves the efficiency of the antenna 212, as discussed with FIG. 3A and FIG. 3B.

Referring to FIGS. 2B and 2C, the conductive cage 216 may include a surface 232 defining an opening 234 in the conductive cage 216. The surface 232 may define a number of openings 234. For example, the surface may define from 1 to 30 of the openings 234. However, embodiments are not so limited. The openings 234 may help to prevent and/or reduce a capacitive coupling between the conductive cage 216 and the PCB 215. The conductive cage 216 may include a plurality of supports 236, such that there is an alternation from a support 236 to an opening 234 to another support 236, e.g., the plurality of supports may be spaced apart. The conductive cage 216 including the supports 236 may be referred to as an open structure. The supports 236 support the PCB 215. For example, the supports 236 may be operable to secure the PCB 215 with the conductive cage 216. As such, the conductive cage 216 may be utilized as a mechanical component of the watch. The supports 236 may secure one or more edges of the PCB 215. As shown in FIG. 2B, the supports 236 may be disposed around a periphery 247 of the PCB 215 to secure at least three sides of the PCB 215. However, embodiments are not so limited. The supports 236 may be disposed along a single edge of the PCB 215. For example, the supports 236 may be disposed along only a first edge 249 of the PCB 215.

One or more supports 236 may enable determining a user input. In some embodiments, user input may be detected by identifying a support 236 that makes electrical and/or physical contact with the PCB 215. For example, the present invention may enable determining depression of a control button 106 of watch 100. The depression of a control button 106 may cause a support 236 to contact PCB 215. The contact may be an electrical contact between support 236 and PCB 215 and/or physical contact between support 236 and PCB 215. For example, depression of a control button 106 may be determined by using a depressible button positioned along the periphery of PCB 215 that is depressed if a support 236 physically contacts the depressible button.

Figure 2D:
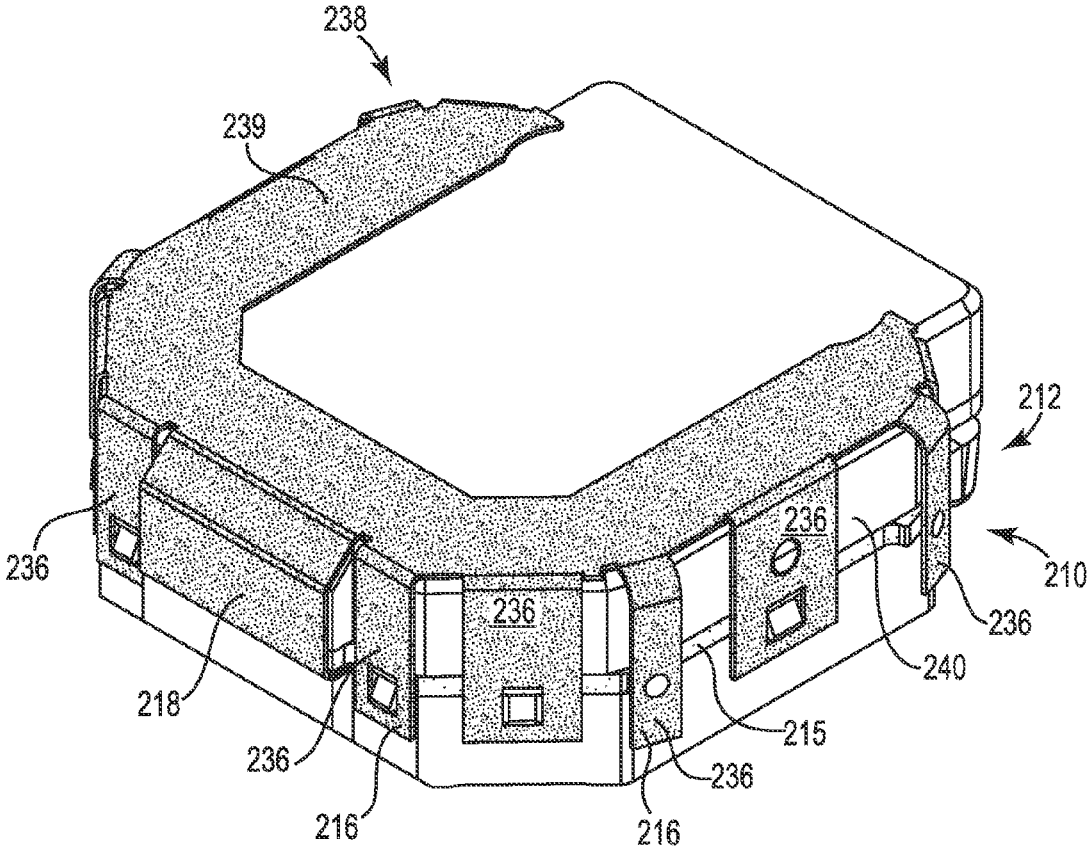
FIG. 2D is a perspective view of a portion of a watch in accordance with one or more embodiments of the present disclosure.

FIG. 2D is a perspective view of a portion of a watch in accordance with one or more embodiments of the present disclosure. FIG. 2D illustrates an internal assembly 238, which is positioned within the housing of the watch. The internal assembly 238 may include, for instance, the PCB 215, the conductive cage 216, and a non-conductive component 240 as shown in FIG. 2D. In some embodiments, the non-conductive component 240 may provide structural support for the cage and/or help separate the conductive cage 216 from the PCB 215 in a manner to minimize interference from stray signals or noise. As shown in FIG. 2D, the conductive cage 216 can include a base portion 239. The supports 236 extend from the base portion 239 and secure PCB 215. FIG. 2D shows a number of the supports 236 contacting a non-conductive component 240 of the internal assembly 238. The supports 236 may be employed to fasten or clamp together various components of the internal assembly 238. In some embodiments, the non-conductive component 240 may include components, including but not limited to, a battery, a sensor, a connector, a speaker, etc. The components included in the non-conductive component 240 may directly or indirectly interact with elements not included in the non-conductive component 240.

Efficiency, which may also be referred to as radiation efficiency, is a characteristic that may be used to assess the quality of an antenna. Efficiency is a measure of the electrical losses that occur throughout the antenna while it is operating at a given frequency, or averaged over its operation across a frequency band. Efficiency can be expressed as a percentage, where 100% (or 1.0) is perfectly lossless and 0% (or 0.0) is perfectly lossy. The efficiency of an antenna that is integrated into a relatively small device, e.g., the watch disclosed herein, can be substantially affected by dielectric materials, such as the housing, which constrain and/or absorb radio frequency energy, like a GPS signal, for example. The efficiency may also be affected by conductive materials and/or living tissue in close proximity to the antenna.

Figure 3A:
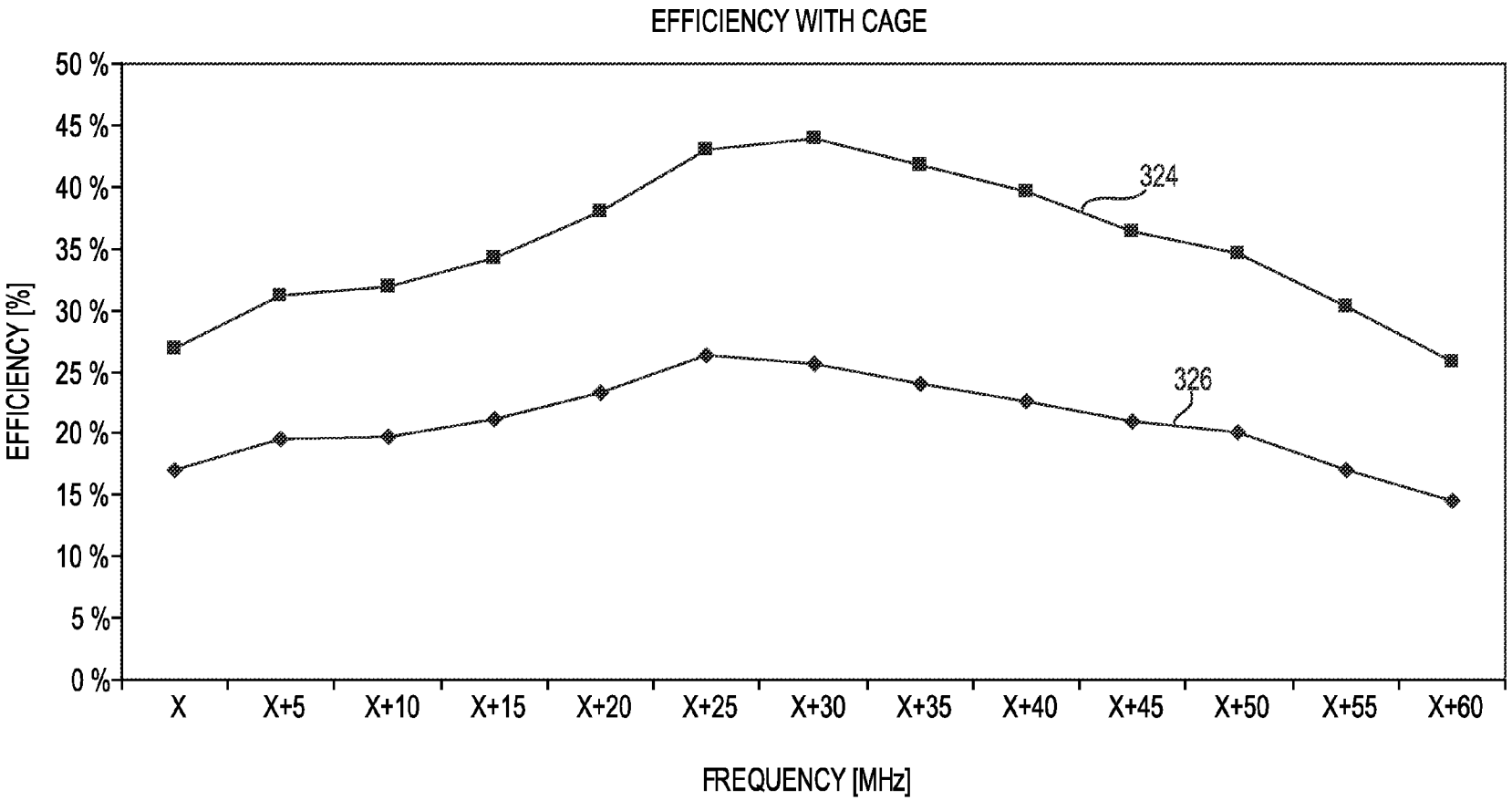
FIG. 3A is an illustration of an efficiency versus frequency diagram associated with a watch in accordance with one or more embodiments of the present disclosure.

FIG. 3A is an illustration of an efficiency versus frequency diagram associated with a watch comprising a location determining component including an antenna in accordance with one or more embodiments of the present disclosure, wherein the ground plane includes a first portion and a second portion. The first portion of the ground plane may be formed by coupling the printed circuit board (PCB) with the antenna. The second portion of the ground plane may be formed by a conductive cage supporting the printed circuit board and electrically coupled thereto. Plot 324 represents data obtained for the watch comprising a ground plane with a first portion and a second portion in free space and plot 326 represents data obtained for the watch in proximity to a portion of a human body, e.g., a wrist. The efficiencies for plot 324 and plot 326 are determined at a range of frequencies from x megahertz (MHz) to x+60 MHz, such that the efficiencies are determined at 5 MHz intervals.

Figure 3B:
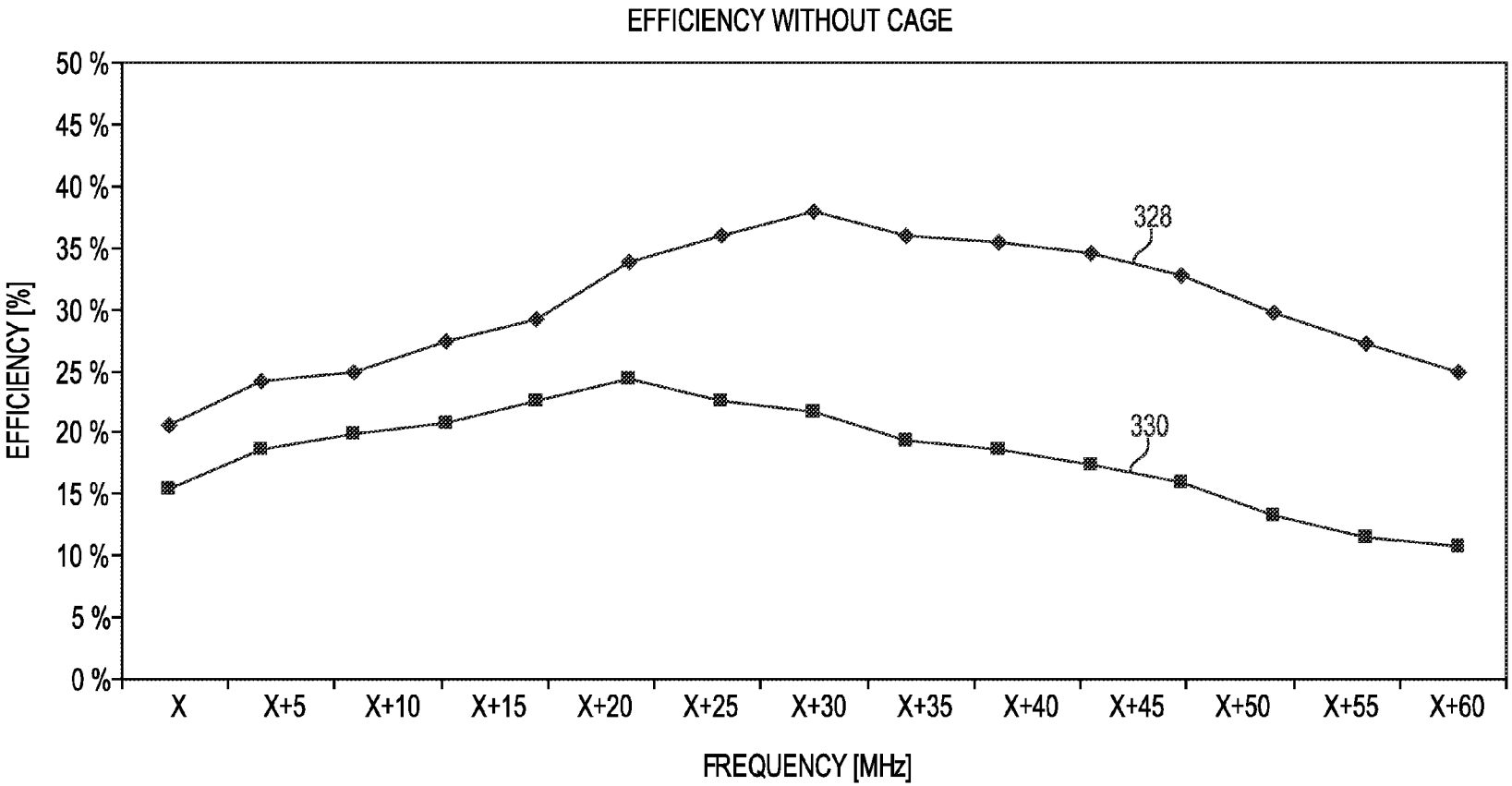
FIG. 3B is an illustration of an efficiency versus frequency diagram associated with a device including an antenna and a ground plane.

FIG. 3B is an illustration of an efficiency versus frequency diagram associated with a conventional device. Plot 328 represents data obtained for the conventional device in free space and plot 330 represents data obtained for the conventional device in proximity to a portion of a human body, e.g., a wrist. The efficiencies for plot 328 and plot 330 are determined at a range of frequencies from x megahertz (MHz) to x+60 MHz, such that the efficiencies are determined at 5 MHz intervals.

As expected, the efficiencies obtained for free space, for both the watch comprising a location determining component including an antenna in accordance with one or more embodiments of the present disclosure, as shown in FIG. 3A, and the conventional device, as shown in FIG. 3B, were greater than the efficiencies obtained in proximity to a portion of a human body. The effects on antennas in proximity to the human body, such as resonant frequency shifts, radiation pattern fragmentation, and/or signal absorption provide the correspondingly lower efficiencies.

Generally, plot 324 and plot 326 of FIG. 3A show that there is an increase in efficiency as compared to plot 328 and plot 330 of the conventional device of FIG. 3B, respectively. This overall increase in efficiency is desirable for the watch. This general increase in efficiency, which may be characterized as an approximately 2 percent to approximately 6 percent increase in efficiency, may help provide greater usability for a watch. The increase in efficiency may allow a watch to receive a GPS signal at a location that otherwise would not allow for a GPS signal to be received. For example, the increase in efficiency may allow the watch to receive a GPS signal beneath a tree or near a building that otherwise would not receive a GPS signal. Advantageously, this increase in efficiency is accomplished without increasing the size of the watch housing to accommodate a larger PCB in order to provide a larger ground plane. Because the PCB is not enlarged to increase the efficiency of the watch, the size of the watch would not be enlarged to achieve the improved signal efficiency.

Figure 4:
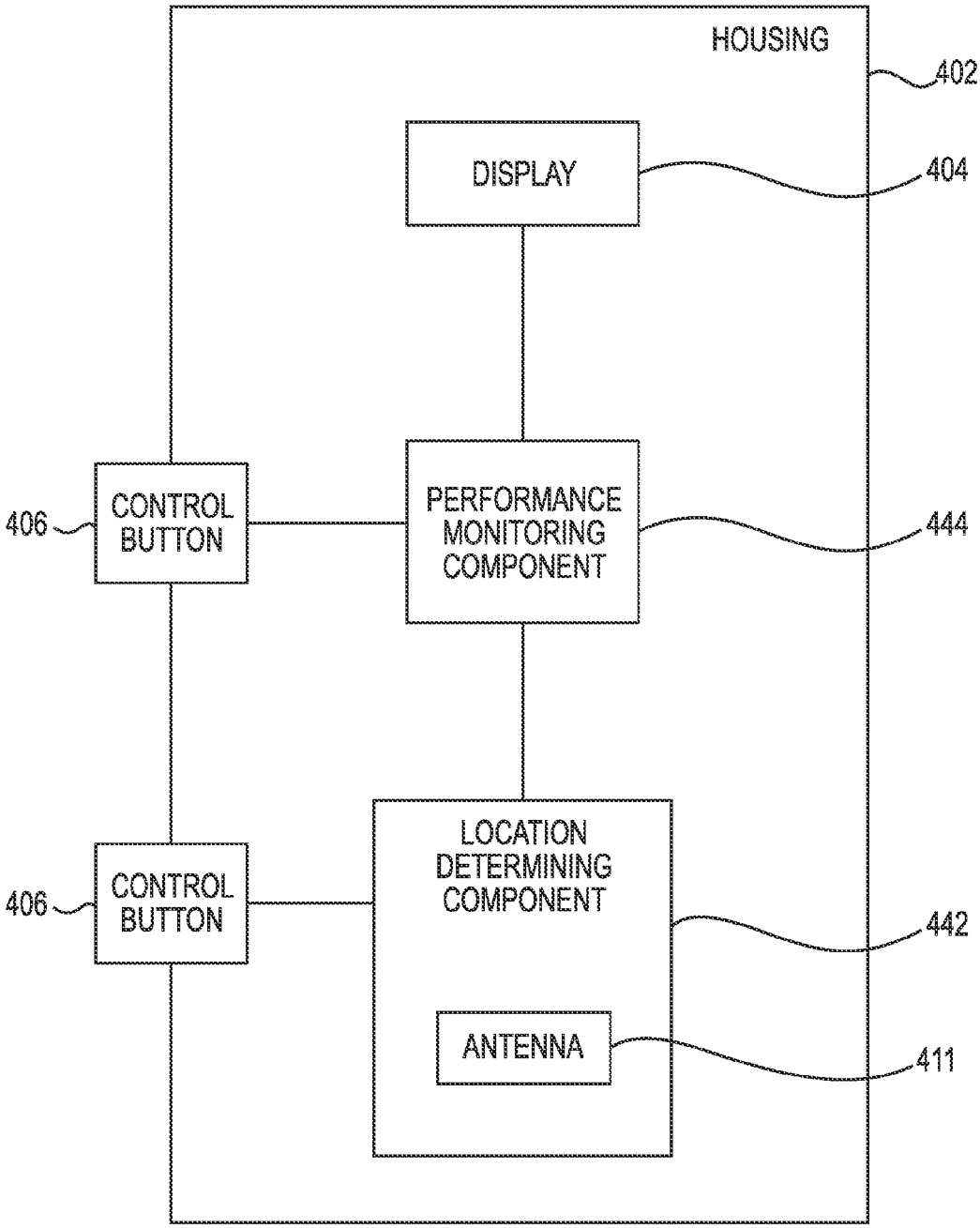
FIG. 4 is a block diagram illustrating a number of components of a watch in accordance with one or more embodiments of the present disclosure.

FIG. 4 is a block diagram illustrating a number of components of a watch in accordance with one or more embodiments of the present disclosure. As seen in FIG. 4, the watch may include a housing 402, a display 404, control buttons 406, a location determining component 442 including an antenna 411, and a performance monitoring component 444. While not shown in FIG. 4, the antenna 411 has a ground plane including a first portion and a second portion, and the watch includes a conductive cage coupled to the PCB to form the second portion of the ground plane, as discussed herein.

In accordance with one or more embodiments of the present disclosure, functions of the watch may be associated with the location determining component 442 and/or the performance monitoring component 444. For example, the location determining component 442 is configured to receive signals, e.g. position determining signals, such as GPS signals, to determine a position of the watch as a function of the signals. The location determining component 442 may also be configured to calculate a route to a desired location, provide instructions to navigate to the desired location, display maps and/or other information on the display 404, to execute other functions described herein, among other things.

The performance monitoring component 444 may be positioned within the housing 402 and be coupled to the location determining component 442 and the display 404. The performance monitoring component 444 may receive information, including, but not limited to geographic location information, from the location determining component 442, to perform a function, such as monitoring performance and/or calculating performance values and/or information related to a watch user's movement, e.g., exercise. The monitoring of the performance and/or the calculating performance values may be based at least in part on the geographic location information. The performance values may include, for example, a user's heart rate, speed, a total distance traveled, total distance goals, speed goals, pace, cadence, and calories burned. These values and/or information may be presented on the display 404.

It is to be understood that elements shown in the various embodiments herein can be added, exchanged, and/or eliminated so as to provide a number of additional embodiments of the present disclosure. In addition, the proportion and the relative scale of the elements provided in the figures are intended to illustrate various embodiments of the present invention and are not to be used in a limiting sense.

Although specific embodiments have been illustrated and described herein, those of ordinary skill in the art will appreciate that an arrangement calculated to achieve the same results can be substituted for the specific embodiments shown. This disclosure is intended to cover adaptations or variations of various embodiments of the present disclosure.

It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the present disclosure includes other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the disclosed embodiments of the present disclosure have to use more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A watch comprising:

an antenna operable to receive position determining signals and provided with a ground plane including a first portion and a second portion;

a printed circuit board electrically coupled with the antenna to form the first portion of the ground plane;

a processor coupled with the printed circuit board and operable to process the position determining signals received by the antenna;

a conductive cage supporting the printed circuit board and electrically coupled thereto to form the second portion of the ground plane, the conductive cage including a surface defining an opening in the conductive cage; and a housing substantially enclosing the antenna, the printed circuit board, and the conductive cage;

wherein the conductive cage includes a plurality of spaced-apart supports that form the opening in the conductive cage.

2. The watch of claim 1, wherein the antenna is positioned towards a first end of the printed circuit board and the conductive cage electrically coupled with the printed circuit board towards a second end of the printed circuit board, wherein the first end is opposite the second end.

3. The watch of claim 1, wherein the plurality of supports extend from a base portion of the conductive cage.

4. The watch of claim 3, wherein the conductive cage includes a connection element to electrically couple with the printed circuit board to form the second portion of the ground plane.

5. The watch of claim 4, wherein the connection element is one of a conductive spring, a conductive tab, or a conductive bridge.

6. The watch of claim 3, wherein one or more of the plurality of supports are operable to secure the printed circuit board with the conductive cage.

7. The watch of claim 1, wherein the antenna is an omnidirectional antenna.

8. A watch comprising:

an antenna support assembly including a top portion and a bottom portion;

an antenna positioned on the top portion of the antenna support assembly along a first plane, the antenna operable to receive position determining signals and provided with a ground plane including a first portion and a second portion;

a printed circuit board disposed along a second plane and supporting the bottom portion of the antenna support assembly such that the first plane is offset from the second plane, the printed circuit board electrically coupled with the antenna through the antenna support assembly to form the first portion of the ground plane;

a processor coupled with the circuit board and operable to process the position determining signals received by the antenna to determine a current geographic location of the watch;

a conductive cage supporting the printed circuit board and including a connection element to electrically couple with the printed circuit board to form the second portion of the ground plane, the conductive cage including a surface defining an opening in the conductive cage; and a plastic housing substantially enclosing the antenna, the printed circuit board, and the conductive cage;

wherein the conductive cage includes a plurality of spaced-apart supports that form the opening in the conductive cage.

9. The watch of claim 8, wherein the antenna support assembly is positioned towards a first end of the printed circuit board and the connection element is electrically coupled with the printed circuit board towards a second end of the printed circuit board, wherein the first end is opposite the second end.

10. The watch of claim 8, wherein the plurality of spaced-apart supports support the printed circuit board.

11. The watch of claim 10, wherein conductive cage includes a base portion from which the plurality of spaced-apart supports extend.

12. The watch of claim 8, wherein the spaced-apart supports are disposed around a periphery of the printed circuit board.

13. The watch of claim 8, wherein the spaced-apart supports are disposed along only a first edge of the printed circuit board.

14. The watch of claim 8, wherein one or more of the spaced-apart supports are operable to secure the printed circuit board with the conductive cage.

15. The watch of claim 8, wherein the connection element includes a conductive spring to electrically couple the printed circuit board and the conductive cage.

16. The watch of claim 8, wherein the connection element includes a conductive tab to electrically couple the printed circuit board and the conductive cage.

17. The watch of claim 8, wherein the antenna support assembly includes mating elements to electrically couple the antenna with the printed circuit board.

18. The watch of claim 8, wherein the antenna is an inverted-F antenna.

19. A watch comprising:

an antenna support assembly including a top portion and a bottom portion;

an antenna positioned on the top portion of the antenna support assembly along a first plane, the antenna operable to receive position determining signals and provided with a ground plane including a first portion and a second portion;

a printed circuit board disposed along a second plane and supporting the bottom portion of the antenna support assembly such that the first plane is offset from the second plane, the printed circuit board electrically coupled with the antenna through the antenna support assembly to form the first portion of the ground plane;

a processor coupled with the circuit board and operable to process the position determining signals received by the antenna to determine a current geographic location of the watch;

a conductive cage supporting the printed circuit board and including a connection element to electrically couple with the printed circuit board to form the second portion of the ground plane, the conductive cage including a surface defining an opening in the conductive cage;

a plastic housing substantially enclosing the antenna, the printed circuit board, and the conductive cage;

a display coupled to the printed circuit board and configured to display the geographic location of the watch; and a strap coupled to the housing;

wherein the conductive cage includes a plurality of spaced-apart supports that form the opening in the conductive cage.

20. The watch of claim 19, further comprising a non-conductive material between the conductive cage and the printed circuit board.

21. The watch of claim 20, wherein the non-conductive material encloses a sensor operable to interact with the processor.

22. The watch of claim 19, wherein the plastic housing includes a button, wherein the conductive cage contacts the printed circuit board when the button is depressed.

* * * * *